US009986791B2

(12) United States Patent
Botkus et al.

(10) Patent No.: US 9,986,791 B2
(45) Date of Patent: Jun. 5, 2018

(54) CLOSURE DEVICE HAVING AN ACTUATING ELEMENT

(71) Applicant: Fidlock GmbH, Hannover (DE)

(72) Inventors: Breido Botkus, Kassel (DE); Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days. days.

(21) Appl. No.: 14/903,921

(22) PCT Filed: Jun. 25, 2014

(86) PCT No.: PCT/EP2014/063381

§ 371 (c)(1),
(2) Date: Jan. 8, 2016

(87) PCT Pub. No.: WO2015/003904

PCT Pub. Date: Jan. 15, 2015

(65) Prior Publication Data

US 2016/0150857 A1 Jun. 2, 2016

(30) Foreign Application Priority Data

Jul. 11, 2013 (DE) ..... 10 2013 213 637
Nov. 11, 2013 (DE) ..... 10 2013 112 386

(51) Int. Cl.
*A44B 11/25* (2006.01)
*A44B 11/26* (2006.01)

(52) U.S. Cl.
CPC ..... *A44B 11/2592* (2013.01); *A44B 11/266* (2013.01); *Y10T 24/45524* (2015.01)

(58) Field of Classification Search
CPC ..... A44B 11/266; A44B 11/2592; Y10T 24/45524; Y10T 24/45529
See application file for complete search history.

(56) References Cited

U.S. PATENT DOCUMENTS

| | | | | |
|---|---|---|---|---|
| 747,768 | A | 12/1903 | Requard | |
| 2002/0092140 | A1* | 7/2002 | Van Tassel | A44B 11/266 24/614 |
| 2011/0030180 | A1* | 2/2011 | Parisi | A44B 11/2546 24/611 |

(Continued)

FOREIGN PATENT DOCUMENTS

| | | | |
|---|---|---|---|
| CN | 102802458 | A | 11/2012 |
| WO | 2011029582 | A2 | 3/2011 |
| WO | 2011146718 | A1 | 11/2011 |

*Primary Examiner* — Robert Sandy
*Assistant Examiner* — Michael S Lee
(74) *Attorney, Agent, or Firm* — The Webb Law Firm

(57) ABSTRACT

A closure device is provided. The closure device includes a first closure element, a second closure element, which can be arranged on the first closure element in a fixing direction and which is connected to the first closure element in a closed state, and at least one actuating element, which is movably arranged on the second closure element. The at least one of the closure elements has a receptacle into which the other closure element can be shoved at least partially. The second closure element in the closed state is held on the first closure element via the actuating element and for this the second closure element interacts with the actuating element, while in an unloaded state the second closure element can be loosened from the first closure element by activating of the actuating element.

17 Claims, 13 Drawing Sheets

(56) References Cited

U.S. PATENT DOCUMENTS

| | | | | |
|---|---|---|---|---|
| 2011/0239413 | A1 | 10/2011 | Milbright | |
| 2012/0124790 | A1* | 5/2012 | Richards | A44B 11/2519 24/593.1 |
| 2012/0227220 | A1* | 9/2012 | Fiedler | A01K 27/005 24/459 |
| 2014/0173859 | A1* | 6/2014 | Anderson | A44B 11/2592 24/598.1 |
| 2017/0079383 | A1* | 3/2017 | Huang | A44B 11/266 |

* cited by examiner (L-L)

(R-R)

U-U (P-P)

CLOSURE DEVICE HAVING AN ACTUATING ELEMENT

CROSS-REFERENCE TO RELATED APPLICATIONS

This application is the United States national phase of International Application No. PCT/EP2014/063381 filed Jun. 25, 2014, and claims priority to German Patent Application No. 10 2013 213 637.4 filed Jul. 11, 2013, and 10 2013 112 386.4 filed Nov. 11, 2013, the disclosures of which are hereby incorporated in their entirety by reference.

BACKGROUND OF THE INVENTION

The invention concerns a closure device with a first closure element, a second closure element, which can be arranged on the first closure element in a fixing direction and which is connected to the first closure element in a closed state, and an actuating element, which is movably arranged on the second closure element.

Such closure devices can be used in particular wherever two parts need to be detachably joined together. For example, such a closure device is suited as a closure for a bag or some other container, as a retention device or as a connection device for connecting two tension-loaded elements, such as two traction cables or belts. In a specific application, such a closure device can be used, for example, for the coupling of a leash with a collar for a pet.

An application for elements loaded by pressure is also conceivable.

In such a closure device, the second closure element in the closed state is held on the first closure element via the actuating element. For this, the second closure element interacts with the actuating element such that, in a loaded state, when a force is acting on the second closure element relative to the first closure element along the fixing direction, the actuating element is firmly connected to the first closure element and holds the second closure element on the first closure element. In other words, the second closure element is fastened to the first closure element not directly, but it is indirectly held on the first closure element via the actuating element. If the second closure element is loaded by tension, the second closure element acts on the actuating element and locks the actuating element such that the actuating element cannot be released easily from the first closure element and thus the closure device is locked. In the loaded state, the first closure element and the second closure element are firmly joined together in this way via the actuating element.

In an unloaded state, on the contrary, when no force or only a slight force is acting on the second closure element relative to the first closure element, the closure device is not locked, and the second closure element can be loosened from the first closure element by activating of the actuating element.

Traditionally, a snap hook is used for example to couple a dog leash to a dog collar, being arranged on the dog leash and engaging with a fastening stirrup on the dog collar. Such snap hooks are also used to join two tension cables and can basically handle large tensile forces. Especially when used on a dog leash, however, traditional snap hooks may be hard and awkward to handle.

From WO 2011/029582 A2 there is already known a closure device of this kind, in which an actuating element in the closed state is held by friction or by snap action on the first closure element by a (locking) segment which is elastic at least for a section. The actuating element here engages with a locking segment or several locking segments each time in an assigned detent opening on the first closure element, in order to hold the second closure element in a loaded state securely on the first closure element. The detent openings are located in an outer wall of a receptacle of the first closure element, into which the second closure element with the actuating element is shoved at least partly in order to join the two closure elements together.

SUMMARY OF THE INVENTION

A problem which the present invention proposes to solve is to provide an improved closure device which can be actuated in an easy and comfortable manner and at the same time produces a firm connection of two closure elements which cannot be loosened in the loaded state.

Basically, in a closure device according to the invention, the second closure element in the closed state is held on the first closure element via the actuating element and thus a connection is produced between the first closure element and the second closure element. The connection between the actuating element and the first closure element is formed by an at least partly elastic (locking) segment, preferably by friction or snap action, i.e., it preferably constitutes a frictional connection or a snap connection, by virtue of which the actuating element is held by friction or positive locking on the first closure element. The second closure element, on which the actuating element is movably arranged, interacts with the actuating element such that, in the loaded state, i.e., when a force is engaging with the second closure element, the frictional or positive locking connection of the actuating element with the first closure element is locked and cannot be loosened. In the loaded state, the connection is thus undetachable, so that even large forces between the first closure element and the second closure element can be safely withstood by the closure device and an unintentional loosening is prevented.

In the unloaded state, on the contrary, in which little or no force is acting on the second closure element, the closure device is not locked. In other words, while a friction or snap action connection still exists for the actuating element with the first closure element in the unloaded state, it can be loosened in order to separate the first closure element from the second closure element and open the closure device. In the unloaded state, therefore, the closure device can be loosened, the friction or snap action connection between actuating element and first closure element can be abolished, and the actuating element can be removed together with the second closure element from the first closure element.

Because the friction and/or positive locking connection is made by an at least partly elastic (locking) segment of the actuating element, an especially firm connection results in the closing state with a friction and/or a positive locking, which is also able to absorb large forces, but at the same time can be loosened again in an easy and comfortable manner.

According to a first aspect of the present invention, a closure device is characterized in that the actuating element has two spatially separated and at least partly elastic locking segments and an actuating segment connecting the locking segments to each other, and the actuating element bears with the locking segments against the first closure element, in order to hold the second closure element on the first closure element. The locking segments can be loosened together from the first closure element by activating the actuating element on the actuating segment. Furthermore, it is provided that, in the connected state of the two closure elements, the at least two locking segments joined together by the actuating segment inside a receptacle, which is defined by at least one of the two closure elements, respectively bear against a retaining segment of the first closure element, extending inside the receptacle, in order to hold the second closure element on the first closure element.

A retaining segment is consequently formed, e.g., not by an inner wall of a receptacle of the first closure element, but instead it extends inside the receptacle at a distance from the walls bordering the receptacle on the outside. For example, this is an elongated central segment on which the elastic locking segment in the closed state bears by friction and/or positive locking in order to hold the second closure element on the first closure element.

Accordingly, a locking segment of the actuating element lies, for example, between at least two edge segments of the closure element, which are spaced apart transversely to the fixing direction and which are shoved into the receptacle of the first closure element and/or define and border on a receptacle for the first closure element on the second closure element. The edge segments of the second closure element define between themselves an interior region of the second closure element in which the actuating element is arranged. The actuating element in preferred variant embodiments is then arranged movably on these edge segments of the second closure element.

In the solution according to the invention, for example, by means of a single handle and by activating the actuating element on the single actuating segment several locking segments can be separated from their respectively coordinated retaining segment or a common retaining segment of the first closure element, so that the second closure element can be released from the first closure element.

In one variant embodiment, the above described retaining segment can be rotationally symmetrical in design, so that the first closure element and the second closure element can be rotated relative to each other in the closed state.

In one variant embodiment, a retaining segment which is configured symmetrically and centrally inside the receptacle of the first or second closure element has at least two opposite retaining surfaces against which one of the locking segments of the actuating element respectively bears in order to hold the second closure element on the first closure element. For example, the retaining segment can project here in the form of a web, a pin, or a peg inside the receptacle and have the retaining surfaces for the actuating element on an outer envelope surface.

In one possible variant embodiment a second closure element with a projecting retaining segment on it in the form of a web, pin or peg is shoved into a receptacle of the first closure element defined between edge segments of the first closure element in order to close the closure device. The first closure element for example can have a compact T-shaped cross section with its projecting retaining segment. The retaining segment can be shoved in between oppositely arranged locking segments of the actuating element. The at least partly elastic locking segments allow the retaining segment to be shoved in, but at the same time ensure that the two closure elements are held against each other in a defined connected state, by the locking segments bearing against the retaining segment in locking manner.

In one sample embodiment, the two closure elements or one of the closure elements—preferably the second closure element with the actuating element—can also be only locally stiffened. In a sample embodiment, the second closure element is stiffened in the regions at which the second closure element is connected to the actuating element and especially the locking segments of the actuating element.

A stiffening can be achieved, for example, by having the closure element appropriately coated and/or made from a second material at the stiffened regions, which has a greater strength as compared to a first material from which the other regions of the closure element are made. A multi-component injection molded part and/or a structural part with at least one metal inlay at least partly overmolded by a plastic material would be conceivable here.

Alternatively or in addition, a stiffening of one region by a separate stiffening element mounted on the closure element can be accomplished. For the fixation, a snap connection can be provided, so that the stiffening element can be easily arranged on the closure element without tools and be secured to it. In one sample embodiment, a stiffening sleeve is provided, which is shoved onto the second closure element—preferably along the fixing direction for the first closure element. Preferably, a fixation of the stiffening sleeve occurs by at least one snap connection in the region of at least one edge segment of the second closure element, for example, by at least one detent opening in the stiffening sleeve, into which a projecting locking catch on the edge segment engages when the stiffening sleeve is shoved onto the second closure part as far as the designed position.

According to a second aspect of the present invention, which can be readily combined with the first aspect, the second closure element has a connecting segment, which joins together the second closure element and the actuating element, so that when a force is acting on the second closure element the connecting segment acts on an (elastic) segment of the actuating element such that the connecting segment presses the segment of the actuating element against a retaining segment of the first closure element in order to hold the second closure element on the first closure element. Accordingly, the segment can also be the above discussed locking segment of the actuating element. Now, according to the invention, it is further provided that the connecting segment is connected by a first film hinge to the second closure element and by a second film hinge to the actuating element.

With film hinges not only can an economical production of the second closure element with the actuating element movably arranged on it be achieved, but also the mobility of the actuating element on the second closure element can be improved.

Preferably, the connecting segment is formed in pressure stable manner between the film hinges. With a pressure-stable connecting segment, one can ensure that it provides a certain pressure stability and thus a better load capacity of the actuating element, especially in the closed state. Furthermore, the coupling of the connecting segment to the actuating element and the second closure element by means of film hinges ensures an easy deformability of the actuating element, so that it can be loosened from the first closure element if needed.

In one variant embodiment the connecting segment between the film hinges is provided with a cylindrical or rotationally symmetrical segment. Such a segment, preferably configured as a solid body, can give the connecting segment the necessary pressure stability. In one variant based on this, a connecting segment between the film hinges for example is provided with a cylindrical body with an elliptical base surface, wherein the film hinges are provided in a region of an envelope surface of the cylinder which lies in the direction of the longer major axis of the ellipse. Thus, a connecting segment joins the two opposite film hinges and extends for example from an edge segment of the second closure element and inward to the actuating element.

According to a third aspect of the present invention, which can be readily combined with the first and second aspects, a guide element is provided, which is led in at least one guide, which bounds an activating path of the actuating element on the second closure element for the releasing of the second closure element from the first closure element.

Consequently, the mobility of the actuating element can be limited by such a guide element to the movement path or movement angle required for the locking or unlocking.

In the case of a second closure element with a connecting segment or several connecting segments and film hinges, the guide element can additionally make sure that no excessive bending or torsional forces can act on a film hinge when the actuating element is activated.

The guide element can be connected to the actuating element and the guide can be formed on the second closure element or vice versa.

In one variant embodiment, the guide element on the second closure element dictates an activating direction of the actuating element for the releasing of the second closure element from the first closure element. In one variant embodiment, an activating direction is dictated, for example, in that the guide element is connected to the actuating element and has two guide pins arranged along a common axis, which are each led in an elongated guide opening (as the guide) extending transversely to this axis on the second closure element.

Furthermore, an actuating segment of the actuating element can define a grip opening, which can be engaged in order to activate the actuating element. In this way, a manual releasing of the two closure elements from each other and thus the opening of the closure device is made easier.

In one variant embodiment, the actuating element has more than two spatially separated locking segments, each of which lie against a retaining segment of the first closure element in order to hold the second closure element via the actuating element on the first closure element. In this case, several (such as three) locking segments are arranged on the actuating element staggered apart in a circumferential direction about the fixing direction. For example, the locking segments can be staggered from each other by 120° in the circumferential direction and in the closed state they can be pressed radially inward in relation to the fixing direction against a common retaining segment of the first closure element in order to hold the second closure element on the first closure element.

Moreover, the geometry of the retaining segment of the first closure element and that of a locking segment or several locking segments of the actuating element can be chosen such that, thanks to the interaction of the respective locking segment with the retaining segment, the second closure element can be held in various positions relative to the first closure element. Thus, the second closure element can be detained in various intermediate positions along the fixing direction. For example, a frictional and/or positive locking connection can be provided for this, so that various detention positions are dictated, for example.

In one variant embodiment, for example a central weblike retaining segment of the first closure element has several convex thickenings along its extension axis, each of them dictating a retaining position for the second closure element. The locking segments of the actuating element each have an inner contour corresponding to the thickenings, preferably a wavy inner contour. Thus, each time one locking segment forms at least one concave bulge, against which a positive locking with a convex thickening is possible.

Since the bulges of the at least partly elastic locking segments lie opposite each other transversely to the fixing direction, a releasable locking of the actuating element is possible at each thickening and thus in different relative positions of the second closure element to the first closure element.

Of course, a locking in different intermediate positions can also be realized with several retaining segments which are similarly coordinated in precise manner with one of several locking segments.

A locking can also be achieved, for example, by a micro-toothing. Here, for example, microscopic detent projections stand off from the locking segments and/or one locking segment essentially perpendicular to the later loading direction. The detent projections can have a rectangular, trapezoidal, or semicircular cross section, for example. Accordingly, the detent projections can not only stand out as teeth, but also be formed by micro-spheres.

A more hard to release locking especially with a micro-toothing can be advantageous in particular in a closure device for a safety-relevant closure. Here, a less free-moving opening of the closure can be tolerated if, in return, an unintentional opening can still be reliably prevented even with heavier loads. For example, a closure device with micro-toothing can be used for the closure of a life jacket.

A closure device according to the invention can be used especially easily as a handle, for example for a bag with roll closure. Usually traditional quick insert buckles are used in bags with roll closure, but these can open unintentionally when used as a handle, since the insert stirrup can be activated unintentionally when grasped by the hand. These drawbacks are avoided with the solution of the invention.

BRIEF DESCRIPTION OF THE DRAWINGS

Further benefits and features of the present invention shall be made clear in the following description of sample embodiments with the help of the figures.

There are shown.

DETAILED DESCRIPTION OF THE INVENTION

Figure 1A:
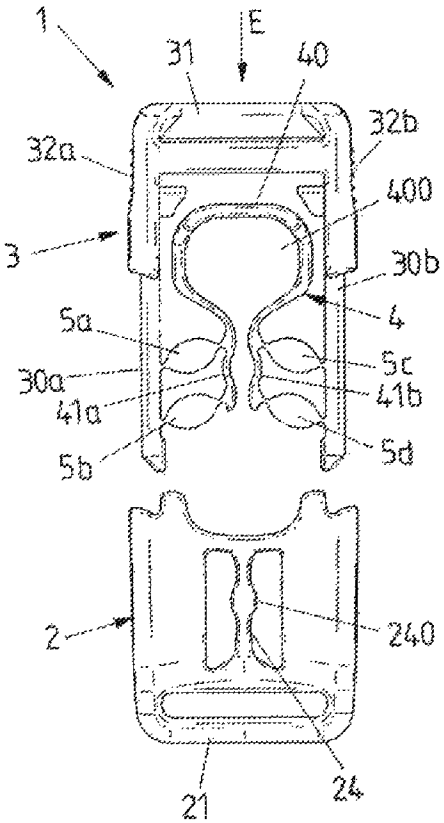
FIGS. 1A-1F, a first sample embodiment of a closure device according to the invention with several locking segments of an actuating element, which in a closed state bear against a common retaining segment which extends inside a receptacle of a first closure element.
Figure 1B:
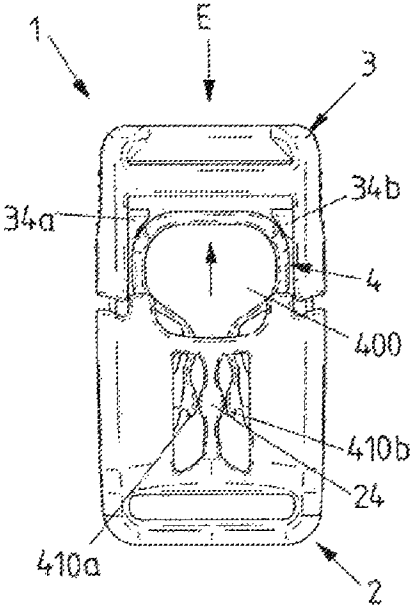
Figure 1C:
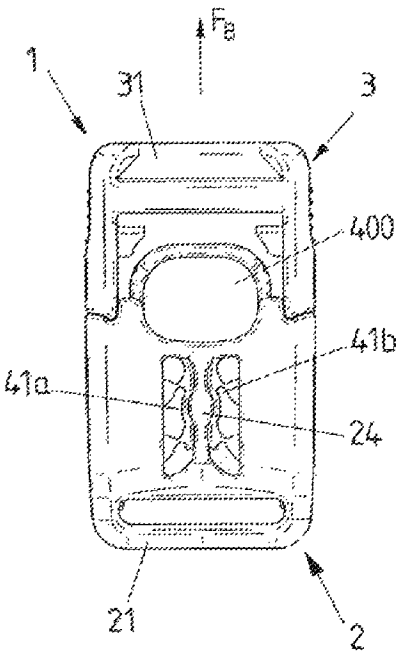
Figure 1F:
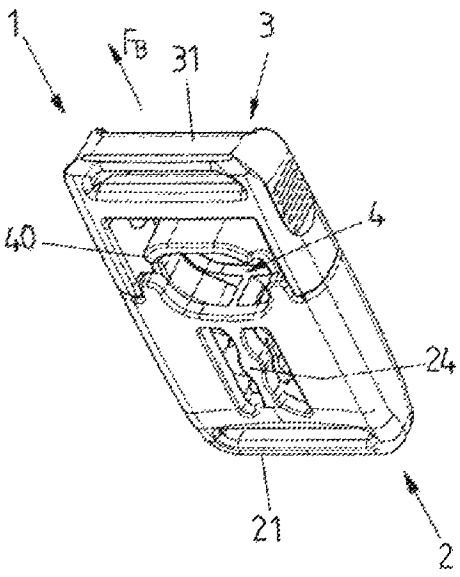
Figure 1E:
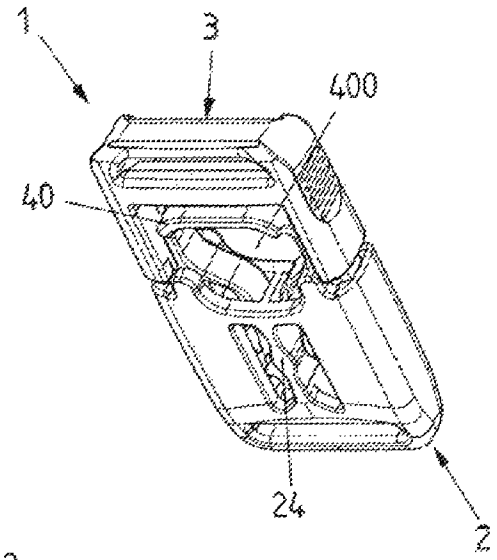
Figure 1D:
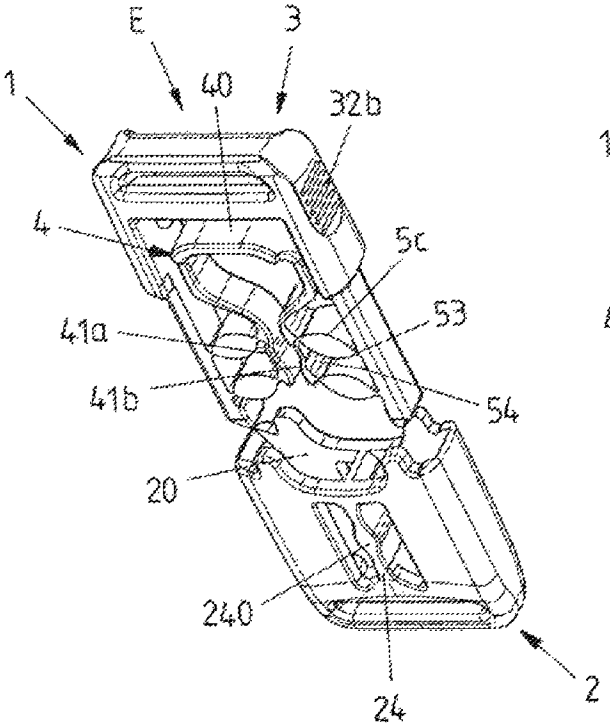
Figure 2A:
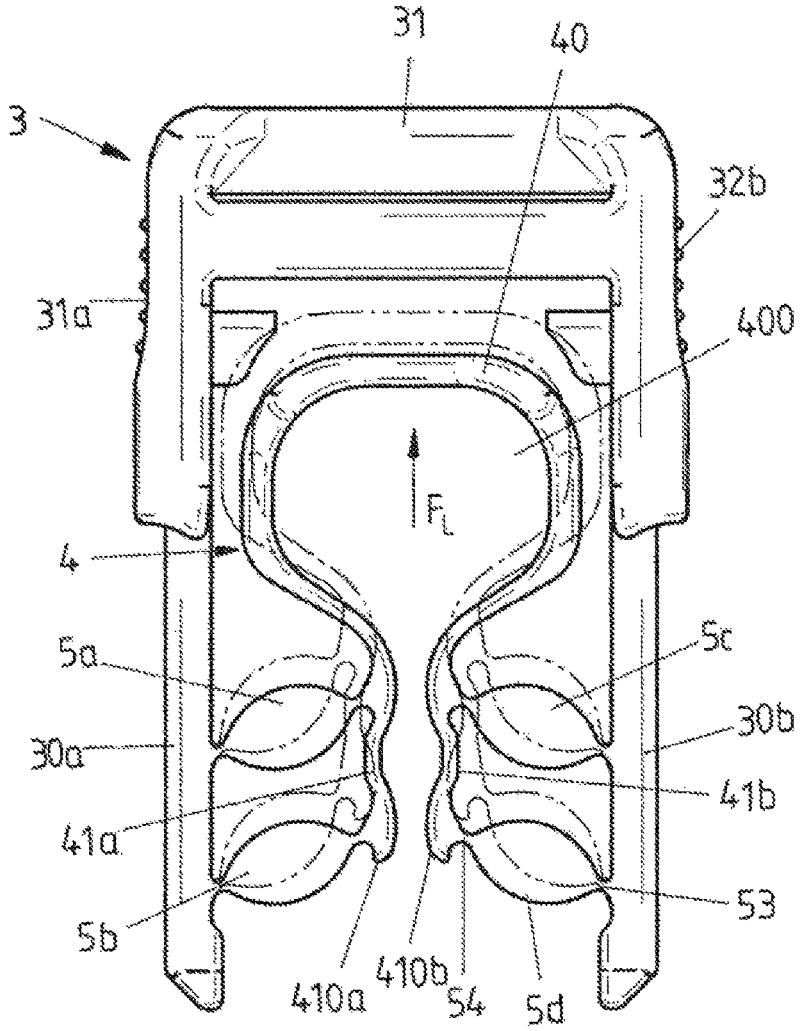
FIGS. 2A-2C, individual views of the second closure element with the actuating element in different positions of the actuating element.
Figure 2C:
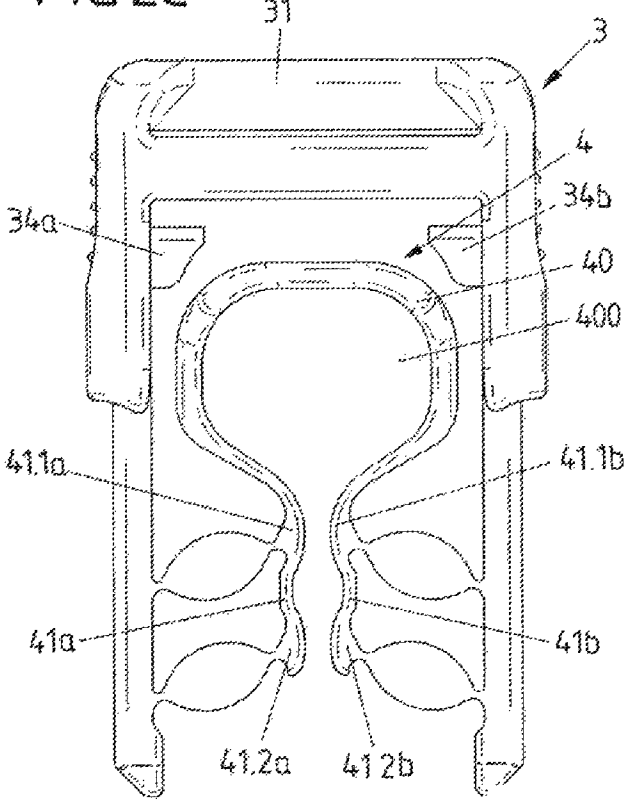
Figure 2B:
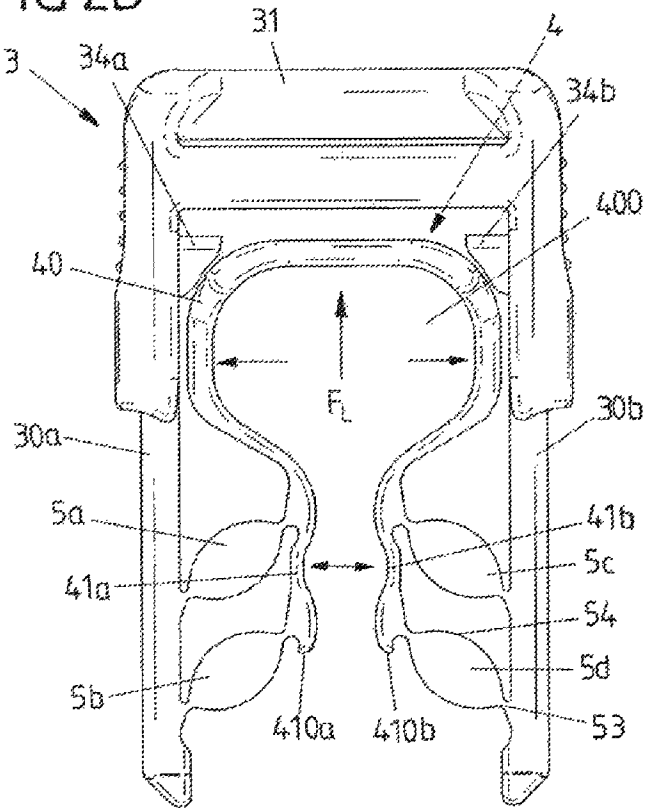
Figure 4B:
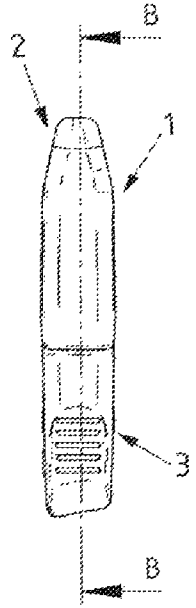
FIGS. 4A-4B, different views of the closure device with activated actuating element in an unloaded state, so that the second closure element can be released from the first closure element.
Figure 4A:
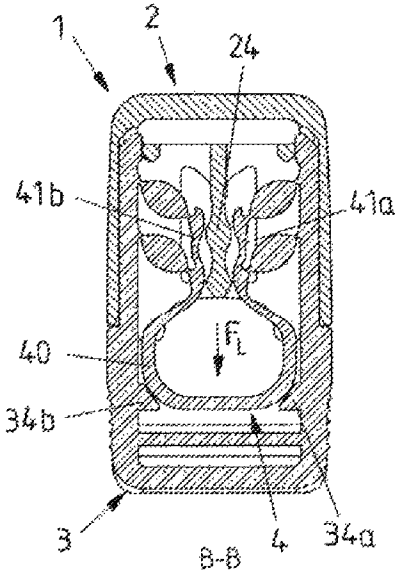
Figure 3B:
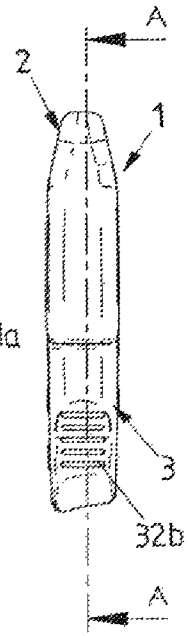
FIGS. 3A-3B, different views of the closure device in a closed state and under loading.
Figure 3A:
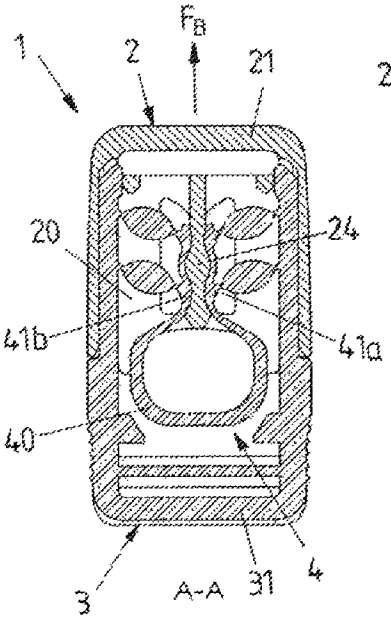
Figure 5A:
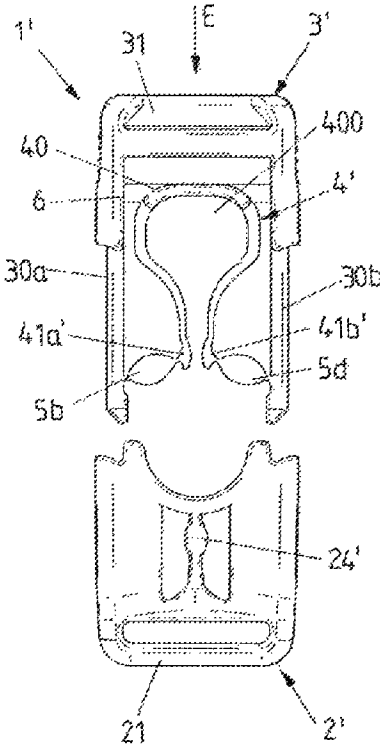
FIGS. 5A-5F, different views of a second sample embodiment of a closure device according to the invention with a modified actuating element, having a smaller number of connecting segments, each of which is connected to the actuating element and the first closure element.
Figure 5B:
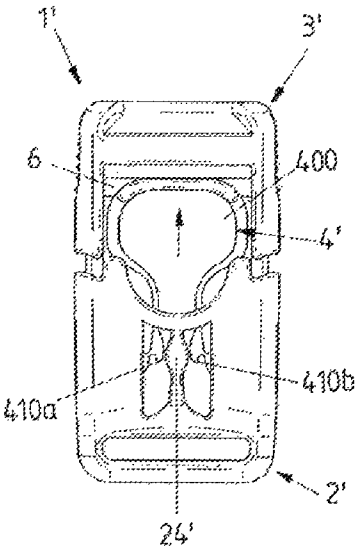
Figure 5C:
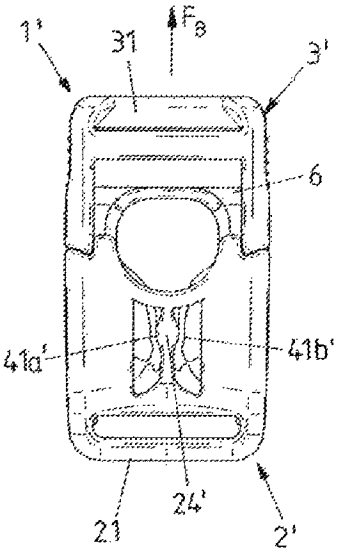
Figure 5F:
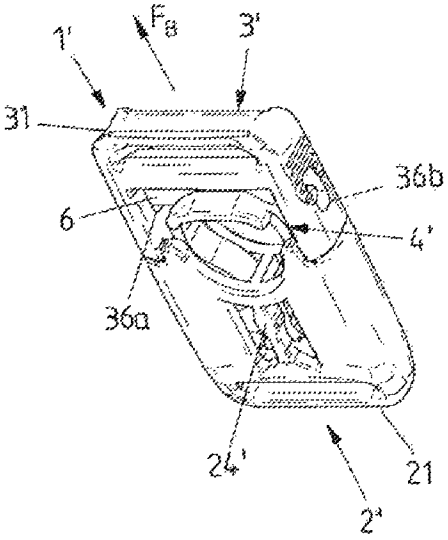
Figure 5E:
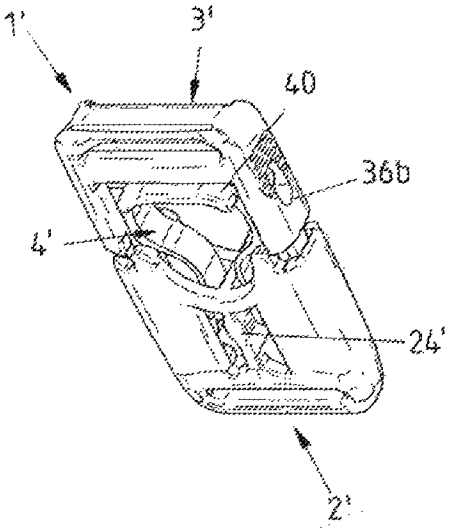
Figure 5D:
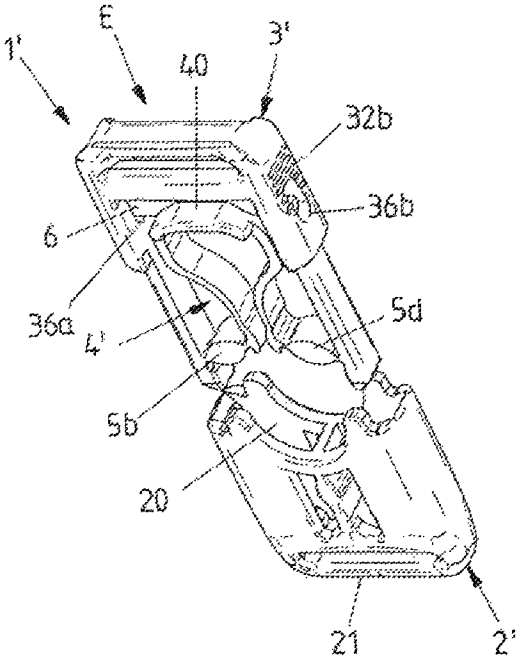
Figure 6A:
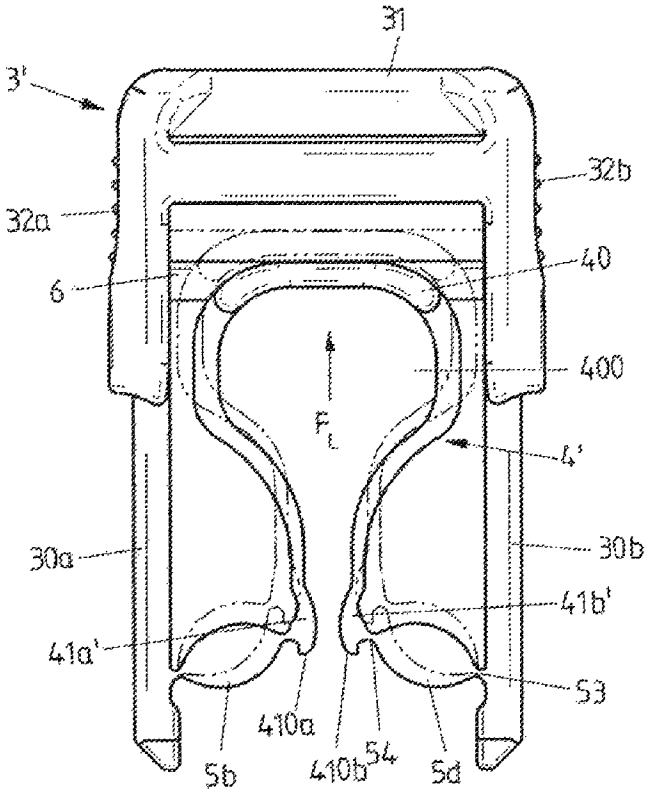
FIGS. 6A-6C, individual views of the second closure element of the closure device of FIGS. 5A-5F with the actuating element in different positions of the actuating element.
Figure 6C:
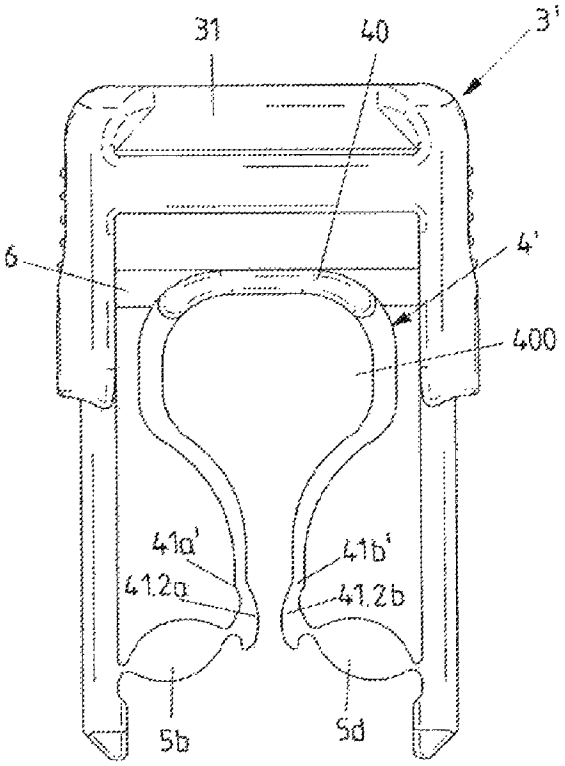
Figure 6B:
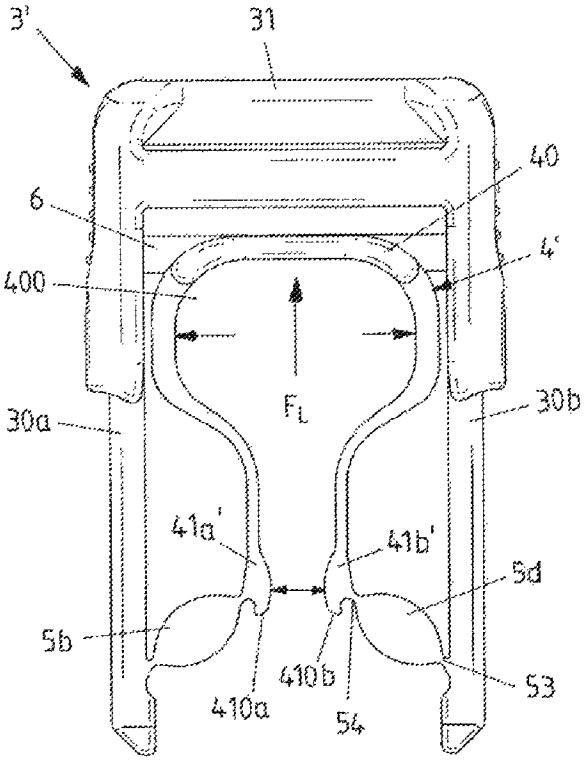
Figure 8B:
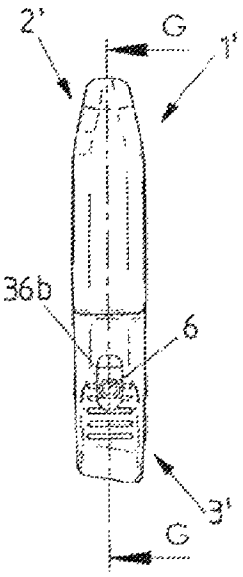
FIGS. 8A-8B, different views of the closure device of FIGS. 5A-5F with activated actuating element in an unloaded state.
Figure 8A:
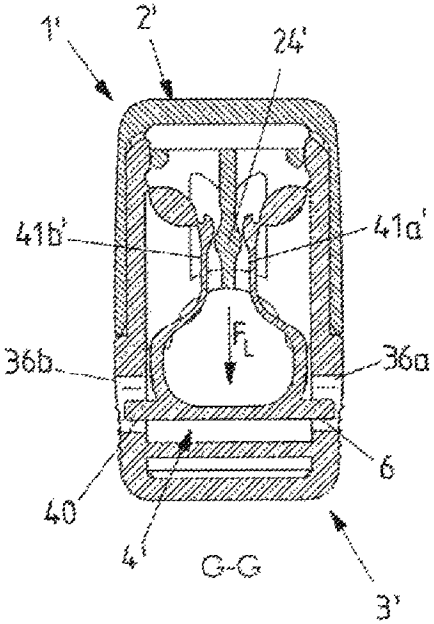
Figure 7B:
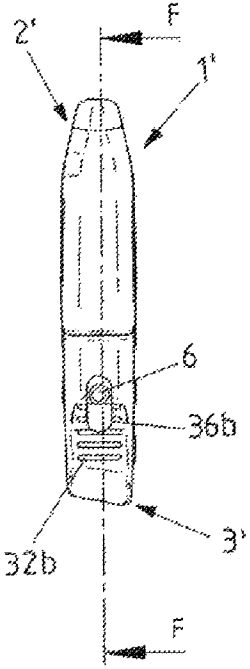
FIGS. 7A-7B, different views of the closure device of FIGS. 5A-5F in a closed state and under loading.
Figure 7A:
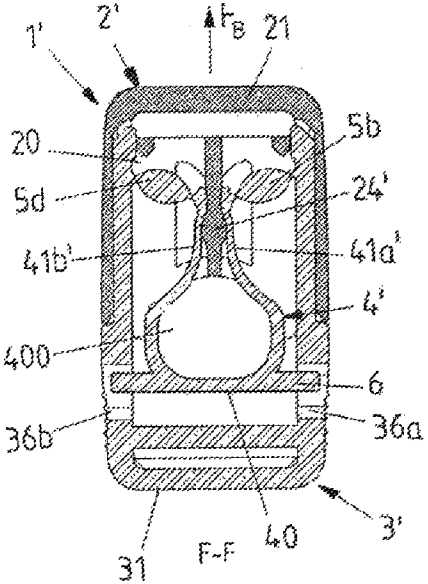

The enclosed FIGS. 1A to 9 show different variants of closure devices according to the invention, each of them implementing the features of the appended claims.

FIGS. 1A to 4B show a first sample embodiment of a closure device 1 according to the invention with a first closure element 2 and a second closure element 3 which can be arranged thereon. The second closure element 3 is in a closed state connected to the first closure element 2 as shown in FIGS. 10, 1F and 3A-3B. The closure device 1 here has an actuating element 4 with two opposing, elastically fashioned locking segments 41*a*, 41*b*, which in a closed state bear against a weblike retaining segment 24 of the first closure element 2 extending within a receptacle 20 in order to hold the second closure element 3 on the first closure element 2.

The two locking segments 41*a* and 41*b*, each formed with a wavy inner contour are joined together by an actuating segment 40, defining a grip opening 400. The second closure element 3, in order to close the closure device 1, is introduced along a fixing direction E partly into the receptacle 20, so that the locking segments 41*a*, 41*b* of the actuating element 4 are received in the receptacle 20 in a closed state, but the actuating segment 40 with the grip opening 400 lies outside the receptacle 20 on the outside for the activating of the actuating element 4.

The positive locking connection of the locking segments 41*a* and 41*b* with the retaining segment 24 occurs by way of two positive locking regions 41.1*a*, 41.2*a* and 41.1*b*, 41.2*b*, which border on a concave bulge on each of the locking segments 41*a* or 41*b*, as well as two pairs of lateral convex thickenings on the retaining segment 24. Thanks to the several (at present: two) lateral thickenings in succession along the retaining segment 24, several (at present: two) detent positions are defined, in which the second closure element 3 is held on the first closure element 2. If the second closure element 3 were shoved far enough into the first closure element 2, the elastic locking segments 41*a* and 41*b* will snap into the retaining segment 24. Then a pair of lateral thickenings of the retaining segment 24 is partly enclosed in opposing concave bulges by the positive locking regions 41.1*a* and 41.2*a* or 41.1*b* and 41.2*b*.

It should be pointed out once more that, of course, instead of a pair of lateral thickenings to define a detent position on the retaining segment 24 one can also provide a single encircling thickening, such as a locking catch, or another geometry extending in a pattern on the retaining segment 24. A geometry extending as a pattern on the retaining segment can be formed, for example, by projecting spherical surfaces or spherical shells, especially by microspheres. It is fundamentally conceivable in this context to provide segments which extend at least partly contrary to the fixing direction E and thus contrary to the loading direction, so that this produces at least one undercut, and when the two closure elements 2 and 3 are connected as intended at least one locking segment 41*a*, 41*b* engages behind the retaining segment 24.

The locking segments 41*a*, 41*b* are arranged centrally between two elongated insert segments 30*a* and 30*b* of the second closure element 3, fashioned as stirrup arms, which define the edge segments of the second closure element 3. The insert segments 30*a* and 30*b* surround the actuating element 40 in a U shape by an end of the second closure element 3 which joins them together. On these insert segments 30*a* and 30*b* are formed moreover two spaced-apart connecting segments 5*a*, 5*b* and 5*c*, 5*d*. The connecting segments 5*a*, 5*b* and 5*c*, 5*d* are joined to their insert segment 30*a* or 30*b* by film hinges 53. Moreover, the connecting segments 5*a* to 5*d* which have a cylindrical segment with an elliptical base surface are each connected by another film hinge 54 to the respective opposite locking segment 41*a*, 41*b*.

The connecting segments 5*a* to 5*d*, which look like lenses here, are configured and oriented such that, when a force $F_B$ is acting on the second closure element 3, the respective connecting segments 5*a*, 5*b* and 5*c*, 5*d* press the locking segments 41*a*, 41*b* against the retaining segment 24 of the first closure element 2 in order to hold the second closure element 3 on the first closure element 2. The connecting segments 5*a* to 5*d* are connected by the film hinges 53 and 54 at places staggered from each other—in terms of the fixing direction E—to an insert segment 30*a* or 30*b* and the neighboring locking segment 41*a* or 41*b*. Since the film hinges 53 and 54 furthermore each extend along the major axis of the elliptical base surface of the connecting segments 5*a* to 5*d*, the connecting segments 5*a* to 5*d* thus in the unloaded state of the actuating element 4 extend at an inclination to a direction of extension of the locking segments 41*a* and 41*b*, coinciding with the fixing direction E. In the unloaded state, therefore, each major axis of the elliptical base surface of a lens-shaped connecting segment 5*a* to 5*d* extends at an acute angle of less than 90°, such as an angle in the range of 45° to 80°, especially around 70°, to the fixing direction E, so that the major axis each time extends from the insert segment 30*a* or 30*b*, to which a connecting segment 5*a* to 5*d* is linked, diagonally in the direction of the actuating segment 40 of the second closure element 3. The major axes of the connecting segments 5*a*, 5*b* and 5*c*, 5*d* are oriented in pairs parallel to each other. In this way, the actuating element 4 in the region of its locking segments 41*a*, 41*b* can be spread open by pulling on the actuating segment 40 opposite the fixing direction E and thus a connection with the retaining segment 24 is easily released.

The actuating element 4 with its locking segments 41*a* and 41*b* is configured such that it can interlock with the retaining segment 24 of the first closure element 2, and thanks to the interaction of the second closure element 3 with the actuating element 4 in a loaded state, for example when a tensile force $F_B$ is acting on the second closure element 3, the actuating element 4 is firmly connected to the first closure element 2 at its retaining segment 24 by positive locking and friction locking. Consequently, in other words, a tensile force $F_B$ acting on the second closure element 3 under load is diverted into a retaining force to secure the positive locking and/or friction connection between the locking segments 41*a*, 41*b* and the retaining segment 24.

By grasping the grip opening 400 and pulling on the actuating segment 40, the locking connection between actuating element 4 and the first closure element 2 is easily released and thus the second closure element 3 is separated from the first closure element 2 contrary to the original fixing direction E. By pulling on the actuating element 4, due to the elasticity of its locking segments 41*a* and 41*b* and the linkage of these locking segments 41*a*, 41*b* to the insert segments 30*a*, 30*b* via film hinges 53, 54, a spreading of the actuating element 4 is achieved especially in the region of the locking segments 41*a*, 41*b*, that is, the locking segments 41*a*, 41*b* are further distanced from each other. In this way, the connection of the locking segments 41*a*, 41*b* with the retaining segment 24 of the first closure element 2 is separated. In other words, an activating force $F_L$ exerted on the actuating element is diverted into a release force for releasing a positive locking and/or frictional connection between the locking segments 41*a*, 41*b* and the retaining segment 24.

The actuating element 4 is arranged movable inside the second closure element 3 such that the activating of the actuating element 4 for the releasing occurs precisely in an activating direction (by applying an activating force $F_L$) in which the second closure element 3 is also moved for the separation from the first closure element 2. Accordingly, an intuitive unlocking of the closure device 1 occurs, in that the second closure element 3 inserted into the first closure element 2 is pulled in the same direction as the actuating element 4 relative to the second closure element 3.

An activating path of the actuating element 4 for the release is limited here by end stops 34*a*, 34*b* formed on the second closure element 3. In this way, when the actuating element 4 is activated, one can avoid an excessive and thus damaging loading of the actuating element 4 along the fixing direction E, as well as that of the film hinges 53, 54. The end stops 34*a* and 34*b* can furthermore limit a movement of the actuating element 4 when the second closure element 3 is shoved into the first closure element 2 when the actuating element comes into contact with the retaining segment 24 via its locking segments 41*a* and 41*b*, which retaining segment projects in the receptacle 20 in the manner of a web in the fixing direction E. Thus, also when the closure device 1 is being closed the end stops 34*a* and 34*b* prevent an excessive and thus damaging loading of the actuating element 4 along the fixing direction E. Thus, it is ensured that no failure of the film hinges 53, 54 will occur when the closure device 1 is opened and closed as designed.

Components to be coupled by the closure device 1, such as belts, cables or leashes, can be fastened on fixing segments 21 and 31 of the closure elements 2 and 3. The fixing segments 21 and 31 extend essentially transversely to the fixing direction E at one end of the respective closure element 2 or 3. The end stops 34*a* and 34*b* for limiting the activating path for the actuating element 4 are each formed in proximity to an (upper) region of the insert segments 30*a*, 30*b* at which the insert segments 30*a* and 30*b* are joined together by the end of the second closure element 3 which is provided with the fixing segment 31.

For easier opening and closing of the closure device 1, grip surfaces 32*a* and 32*b* are provided on lengthwise sides of the second closure element 3. These grip surfaces 32*a* and 32*b* are provided with a ribbed or roughened surface. In this way, the second closure element 3 can be firmly grasped and held between the fingers of one hand.

In order to facilitate the snapping of the actuating element 4 in the retaining segment 24 when the closure device 1 is closed, running surfaces 410*a* and 410*b* are provided at the free ends of the locking segments 41*a*, 41*b*. These running surfaces 410*a*, 410*b* encourage a continual spreading of the actuating element 4 when shoving the second closure element 3 into the first closure element 2 when the running surfaces 410*a*, 410*b* slide along the thickening of the retaining segment 24.

FIGS. 5A to 8B illustrate a second variant of a closure device 1' according to the invention. In contrast with the previously explained sample embodiment of FIGS. 1A to 4B, the actuating element 4' in particular of a second closure element 3' is modified here with its locking segments 41*a'* and 41*b'* so that only just one detent position is dictated here in concert with a retaining segment 24' of a first closure element 2'. The locking segments 41*a'* and 41*b'* each have only a single convex positive locking region 41.2*a* or 41.2*b* with running surface 410*a* or 410*b* at a concave bulge. By means of these positive locking regions 41.2*a* and 41.2*b*, the actuating element 4' can engage behind the retaining segment 24' in the region of a pair of lateral convex thickenings, in order to hold the second closure element 3' on the first closure element 2'. Accordingly, the number of connecting segments 5*b*, 5*d* which connect the locking segments 41*a'* and 41*b'* to the insert segments 30*a* and 30*b*, fashioned as stirrup arms, is also reduced.

Furthermore, the sample embodiment of FIGS. 5A to 8B has no inwardly projecting end stops 34*a*, 34*b*, but instead a guide element 6, which limits the activating path of the actuating element 4'. The guide element 6 is connected to the actuating segment 40 and extends lengthwise. Moreover, the guide element 6 has two pin-shaped ends (guide pins), each guided movably along the activating direction of the actuating element 4' in a guide opening 36*a* or 36*b* on the second closure element 3'. The guide element 6 limits the forces acting in and against the fixing direction E, as well as perpendicular to this (perpendicular to the plane of the drawing), so that the film hinges 53, 54 cannot become overloaded.

Figure 9:
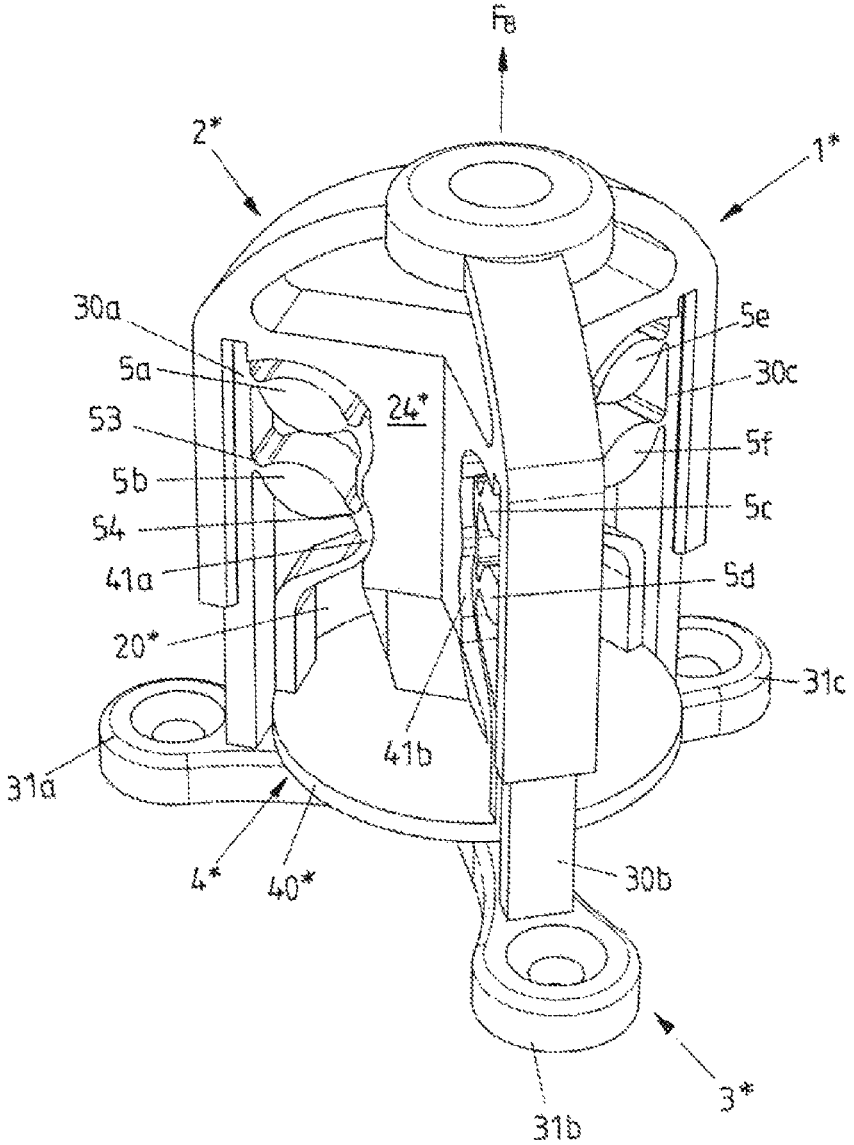
FIG. 9, a third variant of a closure device according to the invention with an actuating element with three locking segments, which are arranged in a circumferential direction about a fixing direction, respectively staggered by 120° in relation to each other, and which bear against a retaining segment situated radially inward between them for the holding of the second closure element on the first closure element.

The sample embodiment of FIG. 9 shows a closure device 1* in which a first closure element 2* has a centrally arranged and elongated retaining segment 24* and a second closure element 3* has three at least partly elastic locking segments arranged staggered by 120° in the circumferential direction in relation to each other about the fixing direction E. The retaining segment 24* projects centrally from an (upper) part of the first closure element 2*, serving as a base, and forms three outwardly projecting retaining webs with the shape of a star in cross section. The three locking segments, of which only two locking segments 41*a*, 41*b* can be seen in FIG. 9, lie against the retaining webs of the retaining segment 24* in locking manner in a closed state, and thus for the locking of the two closure elements 2* and 3* against each other. For this, the locking segments 41*a*, 41*b* once again have a wavy inner contour. This inner contour respectively corresponds to a wavy outer contour of a retaining web of the retaining segment 24*, so that each locking segment 41*a*, 41*b* can bear against it in positive locking and frictional locking when the second closure element 3* has been shoved far enough into the first closure element 2*.

Each locking segment 41*a*, 41*b* is here too arranged with the help of two connecting segments 5*a*, 5*b* or 5*c*, 5*d* or 5*e*, 5*f*, configured identically to the preceding sample embodiments, movably on a respectively coordinated insert segment 30*a*, 30*b*, 30*c* of the second closure element 3*. The pressure-stable cylindrical connecting segments 5*a* to 5*f* are joined each time by film hinges 53, 54 to a locking segment 41*a*, 41*b* and an insert segment 30*a*, 30*b*, 30*c*.

The individual locking segments 41*a*, 41*b* here as well are joined together by a common actuating segment 40* of the actuating element 4*, so that they can be brought simultaneously out of engagement with the retaining segment 24* by applying force to the actuating segment 40*. The actuating segment 40* here is configured as a disk.

Also in the closure device 1* the second closure element 3* with the activating element 4* is shoved into a receptacle 20* of the first closure element 2*. In the closure device 1*, the receptacle 20* of the first closure element 2* is bordered by three arms connected to the retaining segment 24* and enclosing it. The three arms stand out like a claw from a base of the first closure element 2*. A section of belt or cable can be fastened to this base of the first closure element 2*, for example.

On a base of the second closure element 3* opposite the base of the first closure element 2* in the closed state there are furthermore configured here for example three fixing segments 31*a*, 31*b*, 31*c* projecting outward at the side and transversely to the fixing direction E. By these fixing segments 31*a*, 31*b*, 31*c*, the closure element can be fixed to one or more other structural parts. The base of the second closure element 3* furthermore limits the allowable activating path of the actuating element 4, since the actuating segment 40* can be moved at most up to this base opposite the fixing direction E.

Of course, the wavy contours of the locking segments 41*a*, 41*b*; 41*a*', 41*b*' which make possible a positive locking between the respective locking segment and a retaining segment 24, 24', 24* are not mandatory. A pure frictional connection could also be realized here by flat and appropriately roughened surface, for example. A positive locking and/or frictional connection can also be achieved, for example, by a micro-toothing. For example, microscopic detent projections stand out on the locking segments 41*a*, 41*b*; 41*a*', 41*b*' and/or a retaining segment 24, 24', 24* basically perpendicular to the direction of the force or load $F_B$. The detent projections can have for example a rectangular, trapezoidal or semicircular cross section. Accordingly, the detent projections can be formed not only as teeth, but also by microspheres.

FIGS. 10A to 10D and 11A to 11D represent a further variant embodiment of a closure device 1" according to the invention. Here, FIGS. 10A to 10D show two closure elements 2" and 3" in an unconnected state, while FIGS. 11A to 11D show the closure device 1" in the closed state with closure elements 2" and 3" joined together, in various views.

The second closure element 3" of this closure device 1" is based essentially on the second closure element 3 of the sample embodiment of FIGS. 1A to 4B, so that corresponding elements will be given the same reference numbers. Thus, the second closure element 3" of FIGS. 10A to 11D likewise has a movably mounted actuating element 4 arranged between two opposite insert segments 30*a*" and 30*b*". The actuating element 4 comprises the locking segments 41*a* and 41*b* and is mounted by connecting segments 5*a* to 5*d* on the insert segments 30*a*" and 30*b*" such that the actuating element 4 can be spread apart when connecting the two closure elements 2" and 3" to each other and also for releasing the connected closure elements 2" and 3" from each other.

Contrary to the previously explained variant embodiments, the first closure element 2" of the closure device 1" is reduced in design and does not itself form any receptacle 20 in which the actuating element 4 is received with its locking segments 41*a* and 41*b* in the connected state of the two closure elements 2" and 3". Instead, the first closure element 2" has a T shape in cross section. Thus, the first closure element 2" designed as a kind of socket wrench has a base with the fixing segment 21 and a retaining segment 24" extending vertically away from this as a kind of web with a detent region 240". In the base with the fixing segment 21 there are provided two recesses 20*a*" and 20*b*" for better centering of the first closure element 2" on the second closure element 3" and for limiting the degrees of freedom of the first closure element 2" relative to the second closure element 3" in the connected state. These two recesses 20*a*" and 20*b*" engage in the closed state of the closure device 1" with an insert segment 30*a*" or 30*b*" of the second closure element 3". Thus, the weblike retaining segment 24" sticks out between these two recesses 20*a*" and 20*b*" on the first closure part 2".

The two insert segments 30*a*" and 30*b*" in the present closure device 1", together with the base on which the fixing segment 31 is formed, once again define a U-shaped bordered receptacle 30" on the second closure element 3", within which not only does the actuating element 4 lie, but also the first closure element 2" with its retaining segment 24" can be shoved into it upon closing of the closure device 1". In the connected state of the two closure elements 2" and 3", the retaining segment 24" thus extends centrally within a receptacle 30" of the second closure element 3" in this variant embodiment as well, in order to secure the two closure elements 2" and 3" to each other by the bearing of the locking segments 41*a* and 41*b* against the detent regions 240" of the retaining segment 24" lying between the insert segments 30*a*" and 30*b*". But the difference from the previously discussed variants is that an (additional) receptacle surrounding the retaining segment 24" is not formed as well by the first closure element 2".

Building on the design of a second closure element 2 according to the variant embodiment of FIGS. 1A to 4B, in order to make sure that an adequate retaining force is applied by the locking segments 41*a* and 41*b* and the insert segments 30*a* and 30*b* do not become (elastically) deformed under load, so that the first closure element 2" might be released unintentionally, the second closure element 3" in the embodiment of FIGS. 10A to 11D is stiffened in the region of its insert segments 30*a*" and 30*b*".

For this, a stiffening element in the form of a stiffening sleeve 7 as a separate part is shoved onto the second closure element 3" along the fixing direction E and fixed on the second closure element 3". The insert segments 30*a*" and 30*b*" in this way are inserted almost entirely through the stiffening sleeve 7, so that only the ends of the insert segments 30*a*" and 30*b*" stick out from the stiffening sleeve 7, being meant to engage with the recesses 20*a*" and 20*b*" of the first closure element 2". The length of the stiffening sleeve 7, moreover, is chosen such that in the mounted state it does not cover the actuating segment 40 with the grip opening 400 and thus the actuating segment 40 of the actuating element 4 is also easily accessible from the outside in the connected state of the two closure elements 2" and 3".

The fixation of the stiffening sleeve 7 on the second closure element 3" is done by a snap connection. For this, first snap segments with locking catches 300*a*" and 300*b*" projecting slightly to the side are provided on the two insert segments 30*a*" and 30*b*". These locking catches 300*a*" and 300*b*" formed symmetrically to each other on the two insert segments 30*a*" and 30*b*" snap into corresponding detent openings 70*a* and 70*b* of a second snap segment on the stiffening sleeve 7 when this is shoved as intended onto the second closure element 3". In this way, the stiffening sleeve 7 can be mounted without tools on the second closure element 2" and fixed there.

Figure 10C:
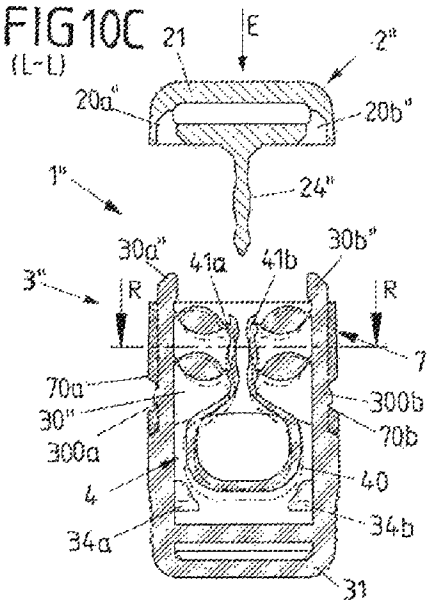
FIGS. 10A-10D, in different views, a fourth sample embodiment of a closure device according to the invention with a first closure element, on which a stiffening element is arranged, and a second closure element, which is partly shoved into a receptacle of the first closure element, in an unconnected state of the two closure elements.
Figure 10D:
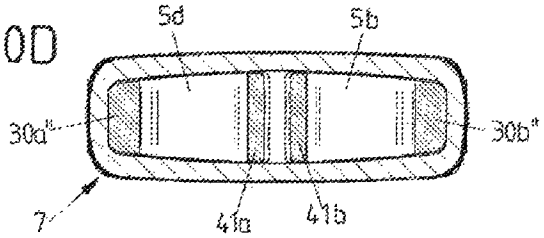
Figure 10B:
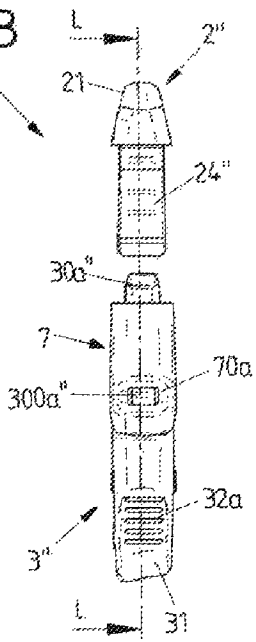
Figure 10A:
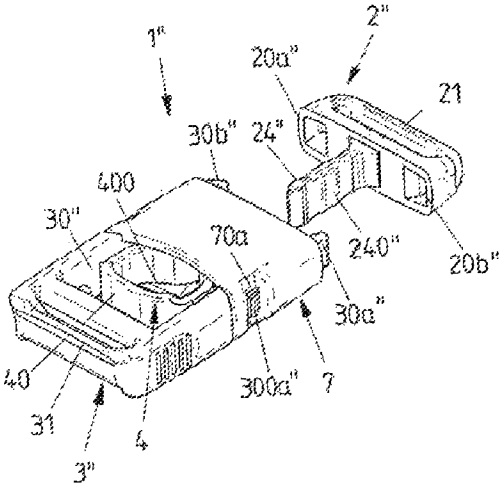
Figure 11C:
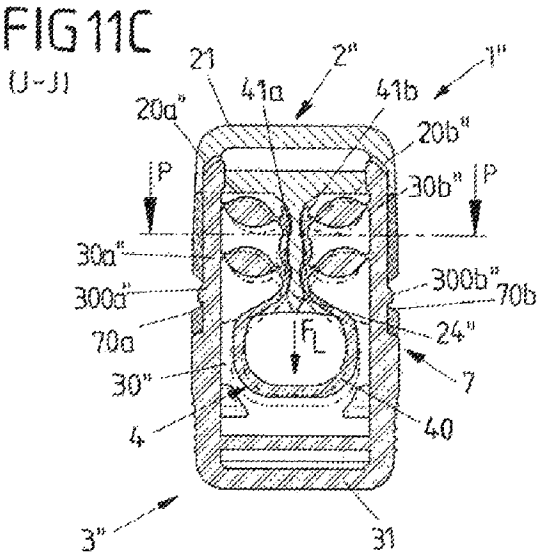
FIGS. 11A-11D, views of the fourth sample embodiment corresponding to FIGS. 10A to 10D in a closed state and thus in a connected state of the two closure elements.
Figure 11D:
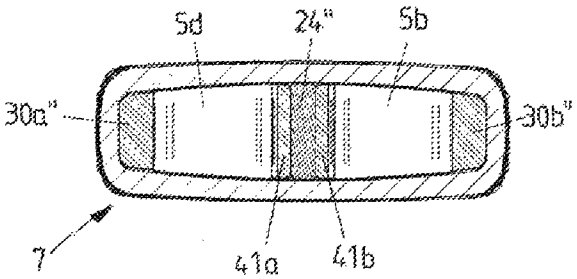
Figure 11B:
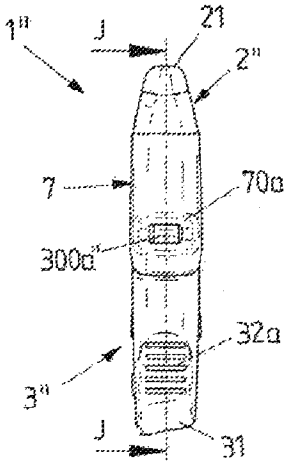
Figure 11A:
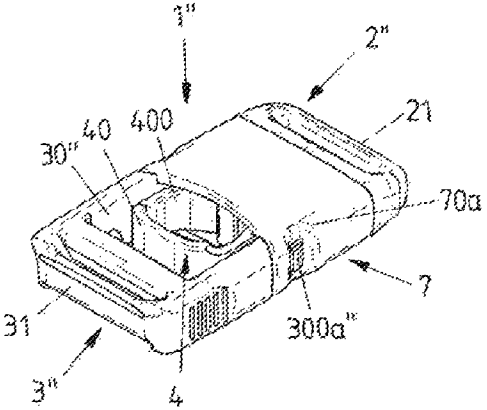

As is especially evident in the sectional representation of FIGS. 10D and 11D, corresponding to the sectioning lines R-R and P-P marked in FIGS. 100 and 110, the stiffening sleeve 7 in the mounted state completely encircles and surrounds the two insert segments 30*a*" and 30*b*" on the outside and thus makes sure that the second closure element 3" is not broadened either when the retaining segment 24" of the first closure element 2" is introduced between the locking segments 41*a*, 41*b* nor when the closure device 1" is loaded in the area of its insert segments 30*a*" and 30*b*", such that the closure device 1" might not be properly closed or unintentionally be opened. Thus, it is ensured that the two closure elements 2" and 3" are held together by the positive locking and/or frictional bearing of the locking segments 41*a* and 41*b* against the retaining segment 24" received between them in the connected state and their connection can only be released under activation of the actuating element 4, as is illustrated for example in the sectional representation of FIG. 11C.

Especially in the variant embodiment of FIGS. 10A to 10D and 11A to 11D it is conceivable that a second closure element 3" can be combined with different first closure elements 2 or 2". In this case, the second closure element 3" without stiffening sleeve 7 can be shoved by its insert segments 30*a*" and 30*b*" into a receptacle 20 formed by the first closure element 2. If a combination of the second closure element 3" with a first closure element 2" is provided, which does not itself have any receptacle 20 almost entirely enclosing the insert segments 30*a*" and 30*b*", but instead is shoved by its free standing retaining segment 24" into the receptacle 30" defined by the second closure element 3", the second closure element 3" is provided with the stiffening sleeve 7 for this. In this way, a design set can be provided in a simple manner for different closure devices 1, 1', 1" in which a second closure element 3" with or without stiffening sleeve 7 can be combined with different first closure elements 2, 2' and 2".

Another variant calls for the above described retaining segment 24" to be rotationally symmetrical and thus the first closure element 2" and the second closure element 3" in the closed state can be rotated against each other.

All variant embodiments shown are preferably made of plastic and are distinguished, especially thanks to the pressure-stable connecting segments 5*a* to 5*f*, by easy fabrication and excellent robustness, so that they also will not fail during long-term use. Moreover, each time the activating pathway for an actuating element 4, 4', 4* is limited to an allowable degree, in order to avoid in particular an excessive strain on the film hinges 53, 54 when activating the respective actuating element 4, 4', 4*. Furthermore, all variant embodiments shown are distinguished by an intuitive operation, especially during the unlocking process, since for this an actuating element 4, 4', 4* needs to be moved in the same direction relative to the second closure element 3, 3', 3", 3* as that in which the second closure element 3, 3', 3", 3* is removed from the first closure element 2, 2', 2", 2*.

Closure devices of the kind described here can be used wherever two parts need to be joined together in releasable manner. For example, such a closure device is suitable as the closure for a purse or some other container, as a retaining device or a connecting device for connecting two elements loaded by tension, such as two traction cables or belts. In a specific application, such a closure device can be used, for example, to connect a leash to a collar of a pet.

Also conceivable and advantageous are such applications in which the closure device must not open up under load, such as buckles for baby carriers, closures for life jackets, and so on.

LIST OF REFERENCE NUMBERS

1, 1', 1", 1* closure device
2, 2', 2", 2* (first) closure element
20, 20* receptacle
20*a*", 20*b*" recess
21 fixing segment
24, 24', 24", 24* retaining segment
240, 240" detent region
3, 3', 3* (second) closure element
30" receptacle
30*a*, 30*a*", 30*b*, 30*b*", 30*c* insert segment
300*a*", 300*b*" locking catch (1st detent segment)
31 fixing segment
31*a*, 31*b*, 31*c* fixing segment
32*a*, 32*b* grip surface
34*a*, 34*b* end stop
36*a*, 36*b* guide opening
4, 4', 4* actuating element
40, 40* actuating segment
400 grip opening
41.1*a*, 41.2*a* positive locking region
41.1*b*, 41.2*b* positive locking region
410*a*, 410*b* running surface
41*a*, 41*a'* locking segment
41*b*, 41*b'* locking segment
53, 54 film hinge
5*a*-5*f* connecting segment
6 guide element
7 stiffening sleeve (stiffening element)
70*a*, 70*b* detent opening (2nd detent segment)
E fixing direction
$F_B$ tensile force
$F_L$ activating force

The invention claimed is:

1. A closure device comprising:

a first closure element, a second closure element, which can be arranged on the first closure element in a fixing direction and which is connected to the first closure element in a closed state, and at least one actuating element, which is movably arranged on the second closure element, wherein at least one of the closure elements has a receptacle into which the other closure element can be shoved at least partially, wherein the second closure element in the closed state is held on the first closure element via the actuating element and for this the second closure element interacts with the actuating element such that, in a loaded state, when a force is acting on the second closure element relative to the first closure element along the fixing direction, the actuating element is firmly connected to the first closure element and holds the second closure element on the first closure element, while in an unloaded state the second closure element can be loosened from the first closure element by activating of the actuating element, wherein the actuating element has two locking segments, which are spatially separated from each other and at least partly elastic, and an actuating segment connecting the locking segments to each other, and the actuating element bears with the locking segments against the first closure element, in order to hold the second closure element on the first closure element, and the locking segments can be loosened together from the first closure element by activating the actuating element on the actuating segment to spread apart the locking segments, and wherein in the connected state of the two closure elements, the at least two locking segments joined together by the actuating segment inside the receptacle respectively bear against a retaining segment of the first closure element, extending inside the receptacle, in order to hold the second closure element on the first closure element.

2. The closure device as claimed in claim 1, wherein in the closed state in a loaded state the actuating element is held at its locking segment by friction and/or positive locking on the retaining segment of the first closure element.

3. The closure device as claimed in claim 1, wherein the at least two locking segments of the actuating element are arranged between at least two edge segments of the second closure element, which are spaced apart transversely to the fixing direction and are shoved into the receptacle of the first closure element or border on the receptacle.

4. The closure device as claimed in claim 1, wherein a retaining segment, against which a locking segment bears in the closed state, extends lengthwise and/or centrally within the receptacle.

5. The closure device as claimed in claim 1, wherein the locking segments bear against a common retaining segment of the first closure element.

6. The closure device as claimed in claim 5, wherein the locking segments each bear against one of at least two retaining surfaces of the retaining segment in order to hold the second closure element on the first closure element.

7. The closure device as claimed in claim 1, wherein a friction locking or snap connection between the actuating element and the first closure element is locked in the loaded state of the second closure element, but can be released in the unloaded state of the second closure element.

8. The closure device as claimed in claim 1, wherein an actuating segment of the actuating element defines a grip opening, which can be grasped in order to activate the actuating element.

9. The closure device as claimed in claim 1, wherein the actuating element has more than two spatially separated locking segments, each of which lie against a retaining segment of the first closure element in order to hold the second closure element via the actuating element on the first closure element.

10. The closure device as claimed in claim 9, wherein the locking segments are provided on the actuating element staggered apart in a circumferential direction about the fixing direction.

11. A closure device comprising:

a first closure element, a second closure element, which can be arranged on the first closure element in a fixing direction and which is connected to the first closure element in a closed state, and at least one actuating element, which is movably arranged on the second closure element, wherein the second closure element in the closed state is held on the first closure element via the actuating element and for this the second closure element interacts with the actuating element such that, in a loaded state, when a force is acting on the second closure element relative to the first closure element along the fixing direction, the actuating element is firmly connected to the first closure element and holds the second closure element on the first closure element, while in an unloaded state the second closure element can be loosened from the first closure element by activating the actuating element to spread apart the actuating element, wherein the actuating element in the closed state is held by an at least partly elastic segment on the first closure element, wherein the second closure element has a connecting segment, which joins together the second closure element and the actuating element, so that when a force is acting on the second closure element the connecting segment acts on a segment of the actuating element such that the connecting segment presses the segment of the actuating element against a retaining segment of the first closure element in order to hold the second closure element on the first closure element, and wherein the connecting segment is connected by a first film hinge to the second closure element and by a second film hinge to the actuating element.

12. The closure device as claimed in claim 11, wherein the connecting segment is formed in pressure stable manner between the film hinges.

13. The closure device as claimed in claim 11, wherein the connecting segment between the film hinges is provided with a cylindrical or rotationally symmetrical segment.

14. A closure device comprising:

a first closure element, a second closure element, which can be arranged on the first closure element in a fixing direction and which is connected to the first closure element in a closed state, and at least one actuating element, which is movably arranged on the second closure element, wherein the second closure element in the closed state is held on the first closure element via the actuating element and for this the second closure element interacts with the actuating element such that, in a loaded state, when a force is acting on the second closure element relative to the first closure element along the fixing direction, the actuating element is firmly connected to the first closure element and holds the second closure element on the first closure element, while in an unloaded state the second closure element can be loosened from the first closure element by activating the actuating element to spread apart the actuating element, wherein the actuating element in the closed state is held by an at least partly elastic segment on the first closure element, and wherein a guide element, which is led in at least one guide, which bounds an activating path of the actuating element on the second closure element for the releasing of the second closure element from the first closure element.

15. The closure device as claimed in claim 14, wherein the guide element is connected to the actuating element and the guide is formed on the second closure element.

16. The closure device as claimed in claim 14, wherein the guide element is connected to the second closure element and the guide is formed on the actuating element.

17. The closure device as claimed in claim 14, wherein the guide element on the second closure element dictates an activating direction of the actuating element for the releasing of the second closure element from the first closure element.

* * * * *